United States Patent [19]

Cotton

[11] 4,356,944

[45] Nov. 2, 1982

[54] METHOD AND APPARATUS FOR BREAKING PRESCORED CERAMIC SUBSTRATE PLATES

[75] Inventor: Leslie L. Cotton, Riverside, Calif.

[73] Assignee: Bourns, Inc., Riverside, Calif.

[21] Appl. No.: 241,262

[22] Filed: Mar. 6, 1981

[51] Int. Cl.[3] ..... B26F 3/00

[52] U.S. Cl. ..... 225/5; 225/98

[58] Field of Search ..... 225/4.2, 5, 98, 96.5

[56] References Cited

U.S. PATENT DOCUMENTS

| | | | |
|---|---|---|---|
| 2,601,200 | 6/1952 | Amos et al. | 225/5 |
| 3,491,929 | 1/1970 | Ueltz et al. | 225/98 X |
| 4,088,255 | 5/1978 | DeTorre | 225/98 |
| 4,195,758 | 4/1980 | Morgan | 225/98 |
| 4,306,672 | 12/1981 | Johannes | 225/5 X |

*Primary Examiner*—Frank T. Yost

*Attorney, Agent, or Firm*—George Jameson; William G. Becker

[57] ABSTRACT

A prescored ceramic substrate plate is broken along each of a plurality of parallel, uniformily-spaced transverse score lines scribed therein by moving the plate, scored side up, along a guide rail and over a break edge into the lower arc of a resilient break roller which is free to rotate. First and second idler rollers apply pressure to the remaining portion of the plate as the plate is being moved. The break roller is canted in the X-axis at a predetermined angle with respect to the break edge for applying a graduated downward pressure onto the plate against the break edge. This angled orientation of the break roller to the break edge sequentially causes the plate to fracture incrementally along each score line as that portion of the plate located at the previously adjacent score line moves into the break roller.

13 Claims, 3 Drawing Figures

METHOD AND APPARATUS FOR BREAKING PRESCORED CERAMIC SUBSTRATE PLATES

BACKGROUND OF THE INVENTION

1. Field of the Invention

This invention relates to the fabrication of ceramic substrates and particularly to an automated apparatus and method for breaking a prescored ceramic substrate plate into a plurality of individual substrates in a manner which simulates the action of breaking the plate by hand.

2. Description of the Prior Art

The typical ceramics used in fabricating substrates for miniature thick film, as well as some thin films, resistor and capacitor components or circuits are composed of 92% to 99% alumina ceramic ($Al_2O_3$), which is amorphous and very hard. The substrates typically are rectangular in shape, between 0.015 to 0.035 inches thick, less than 1.5 inches long and less than ½ of an inch wide.

Impedance films for such resistor and capacitor components (and even inductor components), are conventionally formed on one surface of the substrate by evaporation in the case of thin film components or by conventional silk screen and firing techniques in the case of thick film components. When high volume fabrication is required, the components are usually produced by silk screening the patterns in multiple images (e.g., 2 to 60 or more) in one pass on a large sheet or plate of ceramic material. The large ceramic plate can be prescored between pattern areas by green scoring the plate before it is sintered or by laser scoring the plate to size after it is sintered. The plate can also be postscored to size after the components have been deposited thereon. The scored individual substrates, with their deposited components, are then broken off of the larger ceramic plate.

The methods currently used in mass production applications for breaking the individual substrates off of a larger ceramic plate are generally variations of two basic methods. In the first basic method, the plate is held stationary with a single unit extending over a break edge and then pressure is applied to the scribed side of the extended piece in order to break off the extended unit. In the second basic method, the plate is placed, scribed side down, on a resilient surface and a roller is rolled across the plate with an appropriate pressure to break off successive units.

To date, however, the prior art breaking methods have been characterized by a lack of precise control over the application of pressures, thereby producing decidedly inferior results, in terms of the percentage of substandard or ruined substrates due to incorrect fractures, than those results achieved by manually breaking the individual pieces. However, such manual breaking is a slow and laborious method at best. Thus, until the present invention, high quality production could be achieved only by sacrificing the economy and efficiency of mass production.

One attempt to avoid the trade-off between quantity and quality in ceramic substrate production is described in U.S. Pat. No. 3,507,430. This patent discloses a tool for snapping a prescored ceramic substrate plate into separate substrates. The tool has members which are seated within W-shaped grooves in the plate. The application of pressure to the members snaps a separate substrate off of the plate by removing the central portion of the W. While, in terms of speed, this is an advance over manually breaking the ceramic plate into separate substrates, the need for prescoring the plate with W-shaped grooves, rather than V-shaped grooves, adds to the expense of fabrication, over and above the expense of the specially fabricated tool required.

Various other devices are known in the art for breaking scored workpieces into smaller pieces with both speed and accuracy.

Each of the U.S. Pat. Nos. 2,042,819; 3,141,592; and 4,046,300 discloses an apparatus for breaking scored glass sheets. In U.S. Pat. No. 2,042,819, a scored glass sheet is broken along each scored line as that scored line moves between rollers. In U.S. Pat. No. 3,141,592, a scored glass sheet is broken along each scored line by the fulcrum action of a roller against one end of the sheet as each scored line of the sheet moves between two breaker rollers. In U.S. Pat. No. 4,046,300, a scored glass sheet on a conveyor, stopped over a breakout template, is broken by the movement of a roller over the scored line of the glass.

In a similar manner, each of the U.S. Pat. Nos. 3,105,623; 3,601,296; and 3,870,196 discloses methods and devices for breaking crystalline semiconductor materials. In each of U.S. Pat. Nos. 3,105,623 and 3,601,296 a prescored crystalline semiconductor material, mounted on a resilient flat surface, is broken along each scored line as that scored line moves beneath a roller. In U.S. Pat. No. 3,870,196 a prescored crystalline semiconductor wafer, mounted on a flat resilient pad, is broken along the prescored lines as a roller is moved across the wafer.

However, the above-described methods and devices for breaking glass sheets or crystalline semiconductor materials into smaller pieces are not readily adapted for use on ceramics, due to the unique properties of ceramic materials. The glass breaking devices are specifically used for breaking off relatively large pieces of a material which breaks with far less pressure than does alumina ceramic. The semiconductor breaking devices are designed for operation on material which is, as previously noted, crystalline in nature and which, therefore, easily cleaves along prescored lines. On the other hand, amorphous alumina ceramic lacks such natural cleavage.

None of the above-described prior art devices and methods teaches an automated apparatus or method for selectively breaking a prescored ceramic substrate plate into a plurality of individual substrates in a manner which simulates the action of breaking the plate by hand.

SUMMARY OF THE INVENTION

Briefly an automated apparatus and method is provided for sequentially causing each of a plurality of score lines in a ceramic substrate plate to incrementally fracture along that score line, in a manner similar to that of the manual breaking of the plate, as the plate is moved along a predetermined path.

In a preferred embodiment, a prescored ceramic plate is firmly guided along a predetermined path in a plane, over a break edge and into the lower portion of a break roller. The axis of the break roller is parallel with the plane and also canted at a preselected angle with respect to the break edge. This orientation of the break roller enables the break roller to initiate a graduated downward break pressure onto the plate against the break edge in order to cause the plate to incrementally fracture across one end of each ceramic substrate that is to be sequentially broken off of the plate.

It is therefore an object of this invention to provide an improved apparatus and method for selectively breaking a prescored ceramic plate.

Another object of this invention is to provide an automated apparatus for simulating the action of breaking a prescored ceramic substrate into individual components by hand.

BRIEF DESCRIPTION OF THE DRAWINGS

These and other objects, features and advantages of the invention, as well as the invention itself, will become more apparent to those skilled in the art in the light of the following detailed description taken in consideration with the accompanying drawings wherein like reference numerals indicate like or corresponding parts throughout the several views and wherein.

DESCRIPTION OF THE PREFERRED EMBODIMENT

Figure 1:
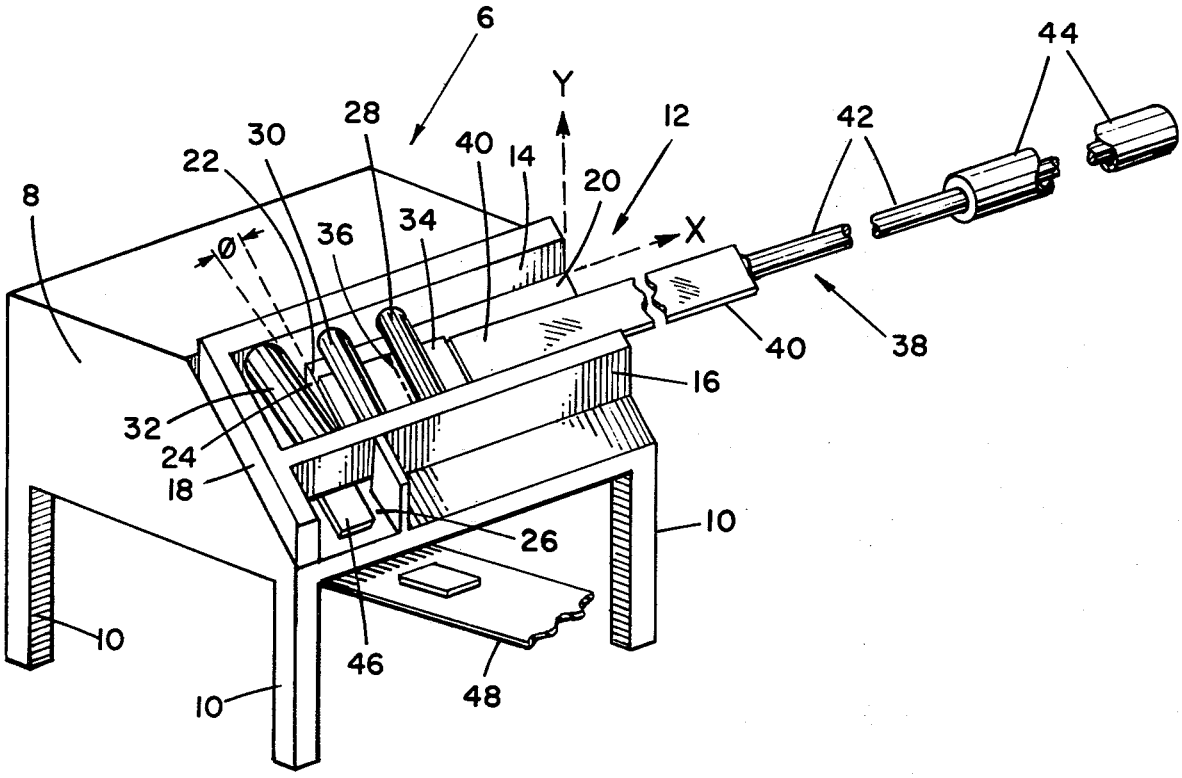
FIG. 1 is a perspective view of a preferred embodiment of the invention.

Referring now to the drawings, FIG. 1 illustrates a perspective view of a preferred embodiment of the invention. More particularly, FIG. 1 illustrates an apparatus 6 for sequentially fracturing a ceramic substrate plate along parallel, uniformly-spaced, transverse score lines to produce a plurality of separate substances. The apparatus 6 includes a body or support table 8 having legs 10. Table 8 has a sloping, rectangularly-shaped framework 12 having side rails 14 and 16 and an end rail 18, which rails collectively define a rectangularly-shaped outer perimeter. A tilted flat upper surface 20, which is longitudinal in shape, lies within the perimeter formed by the rails 14, 16 and 18. The table 8, and hence the surface 20, may be made of stainless steel or some other suitable abrasive-resistant material. The far end of the longitudinal surface 20 terminates at a linear break edge 22 near to and parallel with the end rail 18. The break edge 22 is defined by the intersection of the far end of the surface 20 with one wall 24 of a rectangularly-shaped slide track 26, formed in the body 8 transverse to the longitudinal direction of the surface 20 and between an inner wall (not shown) of the end rail 18 and the far end of the surface 20.

First and second idler pressure rollers 28 and 30 are each rotatably mounted between the rails 14 and 16 at a predetermined distance from the surface 20 and in tandem along the longitudinal axis of the surface 20. A break roller 32, larger in diameter than the rollers 28 and 30, is rotatably mounted over the slide track 26 and between the rails 14 and 16. It should be noted at this time that, for purposes of this discussion, orthogonally displaced X and Y axes (shown as dashed, directional lines X and Y) will be defined as lying in a plane perpendicular to the surface 20, with the X-axis lying in the plane of the surface 20 and being parallel to the side rail 16. The axes of rotation (not shown) of the rollers 28, 30 and 32 are each parallel to the surface 20, with the axes of the pressure rollers 28 and 30 also being perpendicular to the X-axis.

The roller 32 is adjustable by, for example, conventional micrometer means (not shown) in the X-axis away from or closer to the break edge 22 and in the angle of cant with respect to the break edge 22, and in the Y-axis away from or closer to, but still parallel with, the surface 20. Preferably, the roller 32 is positioned so that its axis is canted in the X-axis at a predetermined angle $\phi$, for example between 2° and 5°, with respect to the break edge 22 and is also positioned in the Y-axis so that the bottom edge of the roller 32 is slightly below the bottom edge of each of the rollers 28 and 30 (to be discussed).

Preferably, the rollers 28, 30 and 32 are all made of polyurethane, with each of rollers 28 and 30 having a hardness of 80 to 90 durometer and roller 32 having a hardness of 30 to 40 durometer. Furthermore, the rollers 28, 30 and 32 are preferably not driven but are free to rotate. In addition, the assembly comprised of the flat surface 20, rails 14, 16 and 18 and rollers 28, 30 and 32 is preferably mounted to the table 8 at an angle, for reasons which will be subsequently discussed. It should, of course, be realized that, within the purview of the invention, said assembly could obviously also be mounted level to the table 8 at a 0° angle.

A prescored ceramic substrate plate 34, having a plurality of uniformly-spaced transverse score lines 36 scribed therein, is placed scribed side up on the surface 20 between the side rails 14 and 16. Since the surface 20 is tilted, the plate 34 slides down to and rests against the side rail 16.

The ceramic substrate plate 34 is preferably composed of a high alumina content material, e.g., 92% to 99% alumina ceramic ($Al_2O_3$), which is amorphous and very hard. However, other materials, such as zircon, aluminum silicates, zirconium dioxide, titanium dioxide, magnesium silicates, barium titanate and combinations thereof, may be used. The width between adjacent score lines 36 is greater than the radius of each of the pressure rollers 28 and 30.

A pushing or moving means 28 is used to move the plate 34 along the longitudinal surface 20. Since one edge of the plate 34 is against the side rail 16, the rail 16 acts as a guide to assure that the orientation of the plate 34 is maintained as it is being moved. The moving means 38 is comprised of a steel plate 40 equal to or less than the thickness of the plate 34 and a thin shaft or rod 42 attached between the steel plate 40 and an end means 44. The leading edge of the steel plate 40 may be beveled. The end means 44 may be pushed by hand or may represent a linear DC (direct current) motor or a float-controlled air cylinder (not shown) which automatically moves the ceramic plate 34 (via the shaft 42 and steel plate 40) a predetermined distance before restracting.

In the operation of the apparatus of FIG. 1, the movement of the steel plate 40 slides the ceramic plate 34 on the surface 20 along the rail 16, under the pressure rollers 28 and 30 and past the break edge 22 into the break roller 32. Such a positive push force, in cooperation with the guidance of rail 16, eliminates skewing and an unevenly applied force, which could result in uneven breaks in the ceramic plate 34.

At this point, reference will be made to FIGS. 2 and 3 to further, and more clearly, show the operation of the apparatus 6 of FIG. 1. Each of FIGS. 2 and 3 is a side elevation view of the apparatus 6 with certain parts removed, such as the legs 10 and rails 14, 16 and 18, to more clearly disclose the structure therebeneath.

As the ceramic plate 34 is being pushed by the moving means 38 under the idler rollers 28 and 30, and into the break roller 32, the rollers 28 and 30 rotate in the indicated clockwise direction and apply pressure to the plate 34 thereunder. It will be recalled that the axis of the break roller 32 is canted in the X-axis with respect to the break edge 22 and that the bottom edge of the roller 32 is positioned below the bottom edge of each of the rollers 28 and 30. More specifically, the bottom edge of the roller 32 is positioned below the upper surface of the plate 34 so that one corner (not shown) of the front edge of the plate 34 will initially strike a lower arc of the canted break roller 32. At this time, the first score line 36 from the end of the plate 34 that is making contact with the roller 32 may be a few mils behind the break edge 22. As soon as the break roller 32 makes contact with the front edge of plate 34, the roller 32 starts to apply a graduated downward pressure onto the plate 34 against the break edge 22. As the plate 34 continues to move forward, more and more of the front edge of the plate 34 moves into contact with the lower arc of canted roller 32. The angled or canted orientation of roller 32 thus causes the plate 34 to fracture incrementally along the score line 36, thereby simulating a manual breaking action.

The entire breaking action normally takes only a few microseconds to happen. Optimally, a complete break should occur when the plate 34 has been pushed about 1 mil beyond the break edge 22. However, realistically the complete break across the score line 36 of the plate probably occurs between 1 to 5 mils beyond the break edge 22, because of varying tolerances in the score lines 36 and material of each broken piece.

Figure 2:
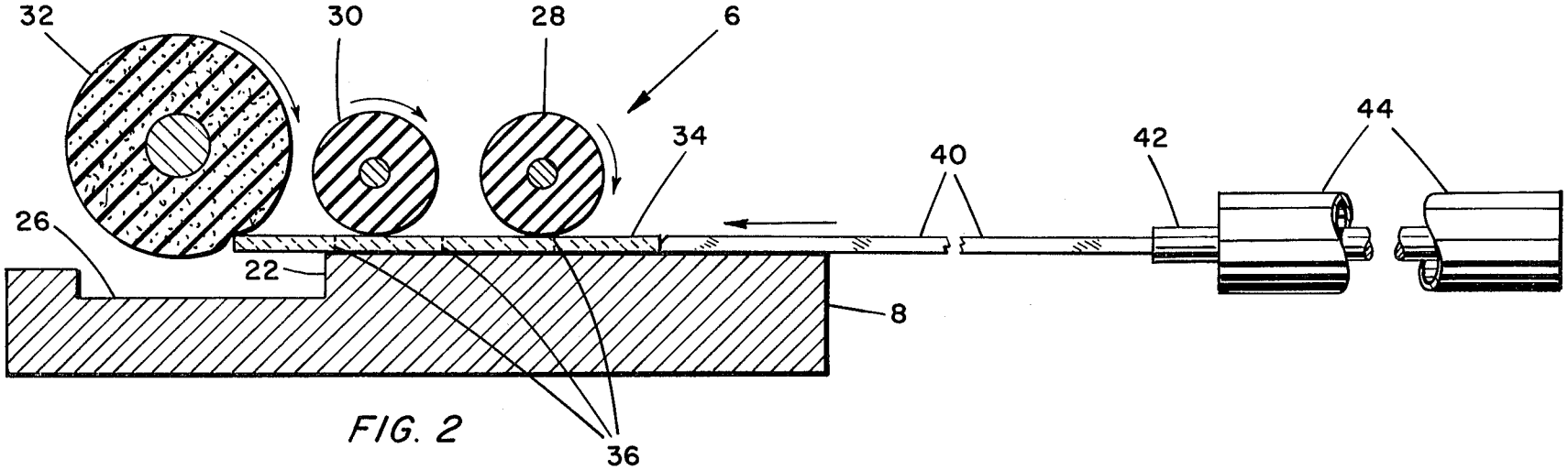
FIG. 2 is a side elevation view, with certain parts broken away and certain parts shown in section, of the preferred embodiment of the invention.
Figure 3:
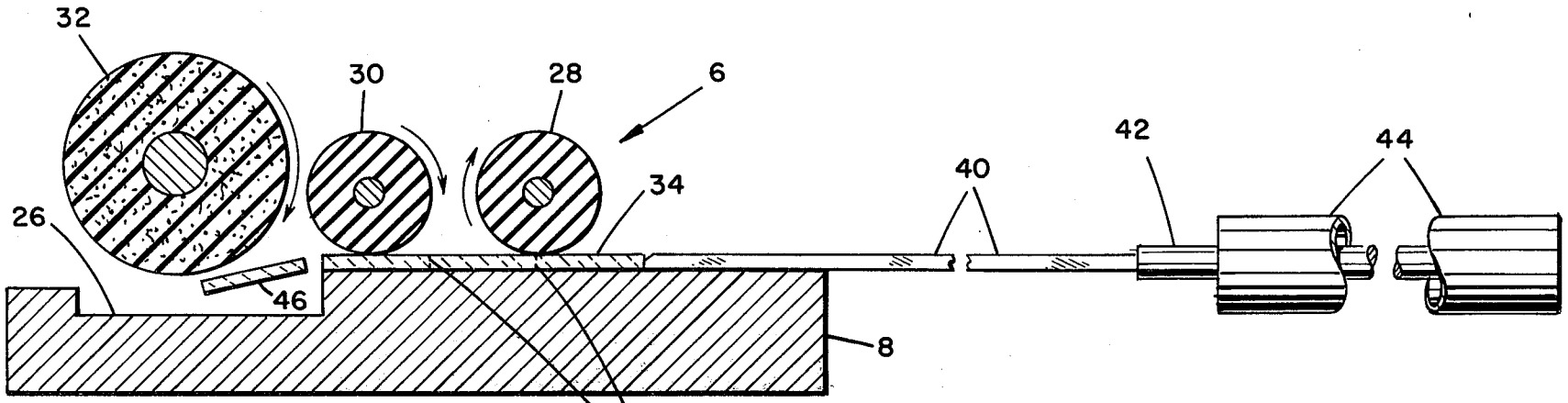
FIG. 3 is a view of the same type as FIG. 1 showing a separate substrate broken from a ceramic plate.

The broken piece or separate substrate 46 is shown in FIG. 2 falling down onto the slide track 26. As shown in FIG. 3, the separate or individual substrate 46 slides down the slide track 26 onto an endless conveyor belt 48 which carries the substrate away to, for example, a work station (not shown).

The plate 34 can be moved at an exemplary velocity of 2 to 3 inches second. The above-described breaking operation is repeated for each substrate 46 that is broken off the plate 34, except for the last one. For a plate 34 that is initially 1 to 2 inches long, a given number of, for example, between 4 and 20 separate substrates 46 can be broken off. The number of substrates depends upon the desired width of each separate substrate 46. The moving means 38 (FIG. 3) retracts, or is retracted, after the last substrate 46 falls onto the slide track 26.

As indicated before, the assembly comprised of the flat surface 20, rails 14, 16, and 18 and rollers 28, 30 and 32 could be mounted level to the table 8. In such an implementation, means, such as horizontally adjustable side rollers, could be mounted to the side rail 14 to maintain the orientation of the plate 34 by forcing the plate 34 against the rail 16, and the slide track 26 could be tilted to enable each substrate 46, that is broken off of plate 34, to slide away from the break edge 22.

The invention thus provides an automated apparatus and method for sequentially causing each of a plurality of score lines in a ceramic substrate plate to incrementally fracture along that score line, in a manner similar to that of the manual breaking of the plate, as the scored plate is moved along a predetermined path, under pressure rollers, over a linear break edge and into the lower arc or portion of a horizontally canted break roller.

While the salient features have been illustrated and described in a preferred embodiment of the invention, it should be readily apparent to those skilled in the art that modifications can be made within the spirit and scope of the invention as set forth in the appended claims.

What is claimed and desired to be secured by Letters Patent of the United States is:

1. An apparatus for sequentially fracturing a ceramic plate along parallel, uniformly-spaced transverse score lines to produce a plurality of separate substrates, said apparatus comprising:

a body for supporting the plate in a predetermined plane, said body having an end, a linear break edge across said end and an exit path adjacent said break edge;

first means for moving the plate along a predetermined path in said plane toward said break edge;

means positioned near said break edge for forcing said plate against said body as the plate is moved toward said break edge; and a break roller positioned ahead of said forcing means and canted in the X-axis at a predetermined angle with respect to said break edge for applying a graduated downward pressure onto the plate against said break edge to sequentially cause the plate to fracture incrementally along each score line and produce a separate substrate as that portion of the plate located at the previously fractured adjacent score line moves into said break roller.

2. The apparatus of claim 1 further including second means for moving each separate substrate away from said break roller and said break edge.

3. The apparatus of claim 2 wherein said second moving means comprises a tilted slide track mounted to said body at said exit path for enabling each separate substrate to slide away from said body.

4. The apparatus of claim 3 further including an endless conveyor belt positioned below said slide track for transporting each separate substrate in sequence to a work station.

5. The apparatus of claim 1 wherein said body comprises a table having a tilted, flat surface lying in said plane and having upper and lower edges.

6. The apparatus of claim 5 wherein said table includes a guide rail positioned at the lower edge of said flat surface for determining the predetermined path in said plane.

7. The apparatus of claim 1 wherein said first means includes:

a guide rail positioned on said body for determining the predetermined path in said plane; and means for pushing the plate along the predetermined path.

8. The apparatus of claim 1 wherein said forcing means comprises:

first and second idling rollers mounted in tandem over the predetermined plane and near said break edge for cooperatively maintaining a low friction support on the plate against said body as the plate is moved toward said break edge.

9. The apparatus of claim 8 wherein each of said first and second idling rollers has a radius smaller than that of said break roller and smaller than the width between adjacent score lines.

10. The apparatus of claim 1 wherein said break roller is comprised of a resilient material.

11. The apparatus of claim 1 wherein said break roller is canted at an angle between 2° and 5° with respect to said break edge.

12. The apparatus of claim 1 or 9 wherein the bottom of said break roller is disposed slightly below the predetermined plane to deflect downward the front portion of the plate moving into said break roller to cause the plate to fracture incrementally along the adjacent score line near said break edge.

13. A method for sequentially fracturing a ceramic plate along a plurality of transverse score lines on one side of the plate to produce a plurality of separate substrates, the method comprising the steps of:

placing the ceramic plate with its scored side up on a tilted, flat surface;

moving the ceramic plate along a predetermined path on the surface past a break edge into a break roller which is canted in the X-axis with respect to the break edge;

maintaining a low friction support against the ceramic plate as it is moving along the predetermined path; and applying a graduated downward pressure on the end of the plate moving into the canted break roller to cause the plate to incrementally fracture along each score line as said each score line moves past the break edge.

* * * * *

UNITED STATES PATENT OFFICE

CERTIFICATE OF CORRECTION

Patent No. 4,356,944 Dated November 2, 1982

Inventor(s) Leslie L. Cotton

It is certified that error appears in the above-identified patent and that said Letters Patent are hereby corrected as shown below:

Column 3, Line 32: "substances" should read -- substrates --.

Column 4, Line 37: "means 28" should read -- means 38 --.

Column 4, Line 50: "restracting" should read -- retracting --.

Column 5, Line 38: insert "per" after -- inches --.

Signed and Sealed this

*Fifteenth* Day of *February 1983*

[SEAL]

*Attest:*

GERALD J. MOSSINGHOFF

*Attesting Officer*

*Commissioner of Patents and Trademarks*